US009856816B2

(12) United States Patent
Kojima et al.

(10) Patent No.: US 9,856,816 B2
(45) Date of Patent: Jan. 2, 2018

(54) CONTROL SYSTEM FOR INTERNAL COMBUSTION ENGINE OF VEHICLE

(71) Applicant: Toyota Jidosha Kabushiki Kaisha, Toyota-shi, Aichi-ken (JP)

(72) Inventors: Susumu Kojima, Susono (JP); Yusuke Suzuki, Hadano (JP); Rui Onoda, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 394 days.

(21) Appl. No.: 14/528,226

(22) Filed: Oct. 30, 2014

(65) Prior Publication Data

US 2015/0142297 A1 May 21, 2015

(30) Foreign Application Priority Data

Nov. 18, 2013 (JP) ..... 2013-238233

(51) Int. Cl.

| | |
|---|---|
| ***F02D 41/30*** | (2006.01) |
| ***F02D 41/06*** | (2006.01) |
| ***F02D 41/04*** | (2006.01) |
| ***F02D 41/00*** | (2006.01) |

(Continued)

(52) U.S. Cl.

CPC ..... *F02D 41/3076* (2013.01); *F02D 41/0025* (2013.01); *F02D 41/047* (2013.01); *F02D 41/062* (2013.01); *F02D 41/068* (2013.01); *F02D 35/025* (2013.01); *F02D 2200/021* (2013.01); *F02N 11/0814* (2013.01)

(58) Field of Classification Search

CPC .. F02D 41/3076; F02D 41/047; F02D 41/062; F02D 41/0025; F02D 41/068; F02D 2200/021; F02D 35/025; F02N 11/0814

USPC ..... 701/102–104, 112–113

See application file for complete search history.

(56) References Cited

U.S. PATENT DOCUMENTS 5,146,882 A * 9/1992 Brinkman ..... F02D 41/062 123/1 A
5,179,925 A * 1/1993 Orminski ..... F02D 19/0628 123/1 A (Continued)

FOREIGN PATENT DOCUMENTS

JP 03124929 A * 5/1991
JP 2007211659 A 8/2007

(Continued)

*Primary Examiner* — Sizo Vilakazi
*Assistant Examiner* — Brian Kirby
(74) *Attorney, Agent, or Firm* — Dinsmore & Shohl LLP

(57) ABSTRACT

When the temperature in a cylinder of an engine is low, the fuel injection amount of fuel that has a low vapor pressure and is less likely to be vaporized is increased, and the fuel injection amount of fuel that has a high vapor pressure and is more likely to be vaporized is reduced, so that the start timing of the engine can be kept constant. When the temperature in the cylinder is high, the fuel injection amount of the fuel that has a low vapor pressure and is more likely to be decomposed is reduced, and the fuel that has a high vapor pressure and is less likely to be burned (decomposed) is increased, so that the start timing of the engine can be kept constant. Thus, the start timing of the engine is kept constant irrespective of the fuel property, and deterioration of the drivability can be curbed.

18 Claims, 11 Drawing Sheets

(51) Int. Cl.
*F02D 35/02* (2006.01)
*F02N 11/08* (2006.01)

(56) References Cited

U.S. PATENT DOCUMENTS 5,499,607 A * 3/1996 Tomisawa ..... F02D 35/023 123/435
5,564,406 A * 10/1996 Klein ..... F02D 41/068 123/681
5,678,520 A * 10/1997 Hori ..... F02D 41/1498 123/406.24
5,884,610 A * 3/1999 Reddy ..... F02D 41/0045 123/520
5,893,349 A * 4/1999 Rado ..... F02D 35/023 123/179.16
6,053,036 A * 4/2000 Uto ..... F02D 41/0042 701/103
6,079,396 A * 6/2000 Ament ..... F02D 41/047 123/491
6,338,336 B1 * 1/2002 Iida ..... F02D 41/0042 123/520
6,481,201 B2 * 11/2002 Kako ..... F01N 11/007 60/274
6,499,476 B1 * 12/2002 Reddy ..... F02D 41/0045 123/520
6,598,589 B2 * 7/2003 Frelund ..... F02D 41/064 123/435
6,637,413 B2 * 10/2003 Maloney ..... F02D 41/0025 123/406.23
6,755,183 B2 * 6/2004 Frech ..... F02D 41/062 123/478
7,987,043 B2 * 7/2011 Tashima ..... F02D 41/0025 123/434
2003/0205218 A1 * 11/2003 McIntyre ..... F02D 41/0025 123/494
2007/0246025 A1 * 10/2007 Sato ..... F02D 41/0045 123/520
2007/0277787 A1 * 12/2007 Husak ..... F02D 41/062 123/491
2008/0154485 A1 * 6/2008 Yasuda ..... F01N 3/101 701/113
2009/0107441 A1 * 4/2009 Husak ..... F02D 41/062 123/179.16
2009/0210136 A1 * 8/2009 Rieder ..... F02D 41/2454 701/103
2009/0292440 A1 * 11/2009 Ichihara ..... F02D 41/0085 701/102
2010/0138136 A1 * 6/2010 Nagasaki ..... F02D 19/0631 701/103
2010/0175657 A1 * 7/2010 Pursifull ..... F02D 41/008 123/179.16
2010/0179743 A1 * 7/2010 Surnilla ..... F02D 41/064 701/103
2010/0241362 A1 * 9/2010 Yoshikawa ..... G01N 21/553 702/24
2010/0294236 A1 * 11/2010 Surnilla ..... F02D 41/0025 123/304
2010/0332108 A1 * 12/2010 Kato ..... F02D 33/02 701/104
2011/0137539 A1 * 6/2011 Jankovic ..... F02D 41/0025 701/103
2011/0137543 A1 * 6/2011 Gibson ..... F02D 41/0087 701/113
2011/0203552 A1 * 8/2011 Aso ..... F02D 41/0025 123/443
2011/0213547 A1 * 9/2011 Reed ..... F02D 41/0235 701/109
2011/0247593 A1 * 10/2011 Yoshizaki ..... F02M 31/18 123/520
2011/0301828 A1 * 12/2011 Moriya ..... F02D 35/023 701/105
2012/0090226 A1 * 4/2012 Lamoureaux ..... C10L 1/02 44/452
2012/0283936 A1 * 11/2012 Hashemi ..... F02D 41/008 701/113
2012/0318241 A1 * 12/2012 Onoe ..... F02D 41/0025 123/515
2013/0253804 A1 * 9/2013 Rosel ..... F02D 41/06 701/104
2013/0298872 A1 * 11/2013 Kojima ..... F02D 41/0025 123/446

FOREIGN PATENT DOCUMENTS

JP 2011-001848 A 1/2011
JP 2011-122461 A 6/2011

* cited by examiner

CONTROL SYSTEM FOR INTERNAL COMBUSTION ENGINE OF VEHICLE

INCORPORATION BY REFERENCE

The disclosure of Japanese Patent Application No. 2013-238233 filed on Nov. 18, 2013 including the specification, drawings and abstract is incorporated herein by reference in its entirety.

BACKGROUND OF THE INVENTION

1. Field of the Invention

The invention relates to a control system for an internal combustion engine of a vehicle, and in particular to a control system that automatically stops and restarts the internal combustion engine.

2. Description of Related Art

A vehicle in which an internal combustion engine is automatically stopped and restarted, depending on running conditions of the vehicle, is known. In the vehicle in which the internal combustion engine is automatically stopped and restarted, it is desirable to keep the start timing of the engine constant when the engine is started (restarted). In this connection, it is described in Japanese Patent Application Publication No. 2007-211659 (JP 2007-211659 A), for example, that, when an alcohol blended fuel containing alcohol is used as a fuel, the fuel injection amount is increased as the concentration of alcohol contained in gasoline is higher (in other words, as the vapor pressure is lower), and the fuel injection amount is increased as the coolant temperature of the internal combustion engine (engine coolant temperature) is lower, so that the start timing of the engine is kept constant.

SUMMARY OF THE INVENTION

In the meantime, when the temperature in a cylinder of the internal combustion engine is in a low temperature range, the likelihood of the fuel to vaporize varies depending on the fuel property, and therefore, the vaporization proportion varies depending on the fuel property. However, when the temperature in the cylinder of the engine is sufficiently high (when the vaporization proportion is high), the fuel is sufficiently vaporized regardless of the fuel property. Once the fuel is vaporized, the fuel is more likely to be burned as hydrocarbon molecules of the fuel are more likely to be decomposed. For example, in the case of heavy fuel having a low vapor pressure (which is less likely to be vaporized), its hydrocarbon molecules, which are large in size and are susceptible to defects, are likely to be decomposed. Accordingly, the heavy fuel is likely to be burned once it is vaporized. On the other hand, in the case of light oil having a high vapor pressure (which is likely to be vaporized), its hydrocarbon molecules are short and small in size, and therefore, are less likely to be decomposed. Accordingly, the light fuel is less likely to be burned once it is vaporized. Thus, the heavy fuel having a low vapor pressure (which is less likely to be vaporized) is more likely to be burned once it is vaporized, than the light fuel having a high vapor pressure (which is more likely to be vaporized). However, in the system of JP 2007-211659 A, the fuel injection amount is uniformly controlled so as to be increased as the vapor pressure is higher, irrespective of the temperature in the cylinder or the vaporization proportion; therefore, the start timing of the engine may not be kept constant, which may result in deterioration of the drivability.

The invention provides a control system for an internal combustion engine of a vehicle, which keeps the start timing of the internal combustion engine constant, for improvement of the drivability.

A control system that automatically stops and automatically restarts an internal combustion engine of a vehicle according to one aspect of the invention includes an electronic control unit configured to (a) set a fuel injection amount when the internal combustion engine is automatically restarted, such that the fuel injection amount is reduced as the temperature in a cylinder of the internal combustion engine or the vaporization proportion of the fuel at the time of automatic restart is higher, and (b) set a relationship between a vapor pressure of a fuel and the fuel injection amount, based on the temperature in the cylinder or the vaporization proportion of the fuel, such that a rate of change of the fuel injection amount relative to the vapor pressure increases as the temperature in the cylinder or the vaporization proportion of the fuel is higher.

Thus, the relationship between the vapor pressure of the fuel and the fuel injection amount is set, based on the temperature in the cylinder of the internal combustion engine or the vaporization proportion of the fuel, such that the rate of change of the fuel injection amount relative to the vapor pressure increases as the temperature in the cylinder or the vaporization proportion of the fuel is higher. The rate of change of the fuel injection amount relative to the vapor pressure increases as the temperature in the cylinder or the vaporization proportion of the fuel is higher, in view of the fact that the start timing of the engine is more influenced by the combustibility of the fuel than the likelihood of the fuel to vaporize as the temperature in the cylinder or the vaporization proportion of the fuel is higher, so that the optimum fuel injection amount that makes the start timing of the engine constant irrespective of the fuel property is set. Thus, the start timing of the engine is kept constant irrespective of the fuel property, so that deterioration of the drivability can be curbed.

In the control system according to the above aspect of the invention, the electronic control unit may be configured to set the relationship between the vapor pressure of the fuel and the fuel injection amount, such that the rate of change is positive when the temperature in the cylinder or the vaporization proportion of the fuel is equal to or higher than a predetermined value. With this arrangement, if the temperature in the cylinder or the vaporization proportion of the fuel is equal to or higher than the predetermined value, the fuel injection amount increases as the vapor pressure increases; therefore, the fuel injection amount of the fuel that has a high vapor pressure and is less likely to be burned is increased. Thus, the optimum fuel injection amount that makes the start timing of the engine constant is set according to the fuel property, so that the start timing of the engine can be kept constant.

In the control system according to the above aspect of the invention, the electronic control unit may be configured to set the relationship between the vapor pressure of the fuel and the fuel injection amount, by switching between a first map and a second map, based on the temperature in the cylinder or the vaporization proportion of the fuel. The first map is used for determining the fuel injection amount when the temperature in the cylinder or the vaporization proportion of the fuel is equal to or lower than a predetermined temperature or a predetermined value, and the second map is used for determining the fuel injection amount when the temperature in the cylinder or the vaporization proportion of the fuel exceeds the predetermined temperature or the predetermined value. Thus, the map indicating the relationship between the vapor pressure of the fuel and the fuel injection amount is appropriately switched depending on the temperature in the cylinder or the vaporization proportion of the fuel, between the first map used when the temperature in the cylinder is equal to or lower than the predetermined temperature or when the vaporization proportion of the fuel is equal to or lower than the predetermined value, and the second map used when the temperature in the cylinder exceeds the predetermined temperature or when the vaporization proportion of the fuel exceeds the predetermined value. In this manner, the optimum fuel injection amount can be determined, based on the map suitable for the temperature in the cylinder or the vaporization proportion of the fuel.

In the control system according to the above aspect of the invention, the electronic control unit may be configured to estimate the temperature in the cylinder, based on an engine coolant temperature. Since it is difficult to directly detect the temperature in the cylinder, the temperature in the cylinder may be estimated from the engine coolant temperature as a value associated with the temperature in the cylinder, and the optimum fuel injection amount may be determined based on the estimated temperature in the cylinder.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
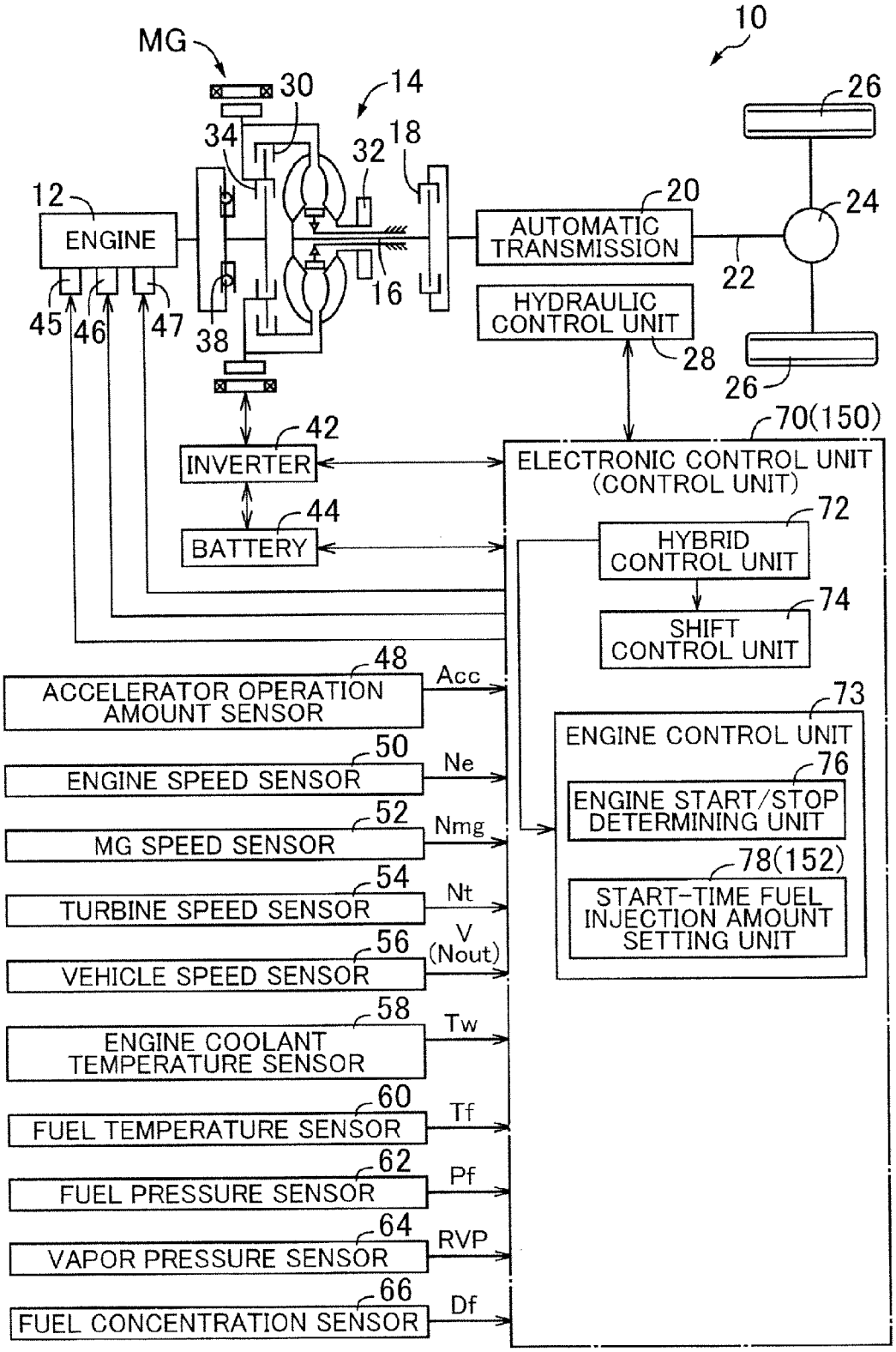
FIG. 1 is a schematic view including a skeleton diagram of a drive system of a hybrid vehicle to which the invention is applied.

One embodiment of the invention will be described in detail with reference to the drawings. In the drawings, respective parts of the following embodiment are simplified or deformed as needed, and the ratios of dimensions, shapes, etc. of the respective parts are not necessarily accurately depicted.

FIG. 1 is a schematic view including a skeleton diagram of a drive system of a hybrid vehicle 10 (which will be simply called "vehicle 10") to which the invention is favorably applied. The vehicle 10 includes a direct-injection engine 12 (which will be simply called "engine 12") in which fuel is directly injected into cylinders, and a motor-generator MG that functions as an electric motor and a generator, as sources of driving force for running the vehicle. The outputs of the engine 12 and motor-generator MG are transmitted from a torque converter 14 as a fluid-type transmission device, to an automatic transmission 20, via a turbine shaft 16 and a C1 clutch 18, and further transmitted to right and left drive wheels 26 via a differential gear unit 24. The torque converter 14 includes a lock-up clutch (L/U clutch) 30 that directly connects a pump wheel and a turbine wheel. An oil pump 32 is integrally connected to the pump wheel, and is mechanically rotated or driven by the engine 12 or the motor-generator MG. The engine 12 corresponds to the internal combustion engine of the invention.

Figure 2:
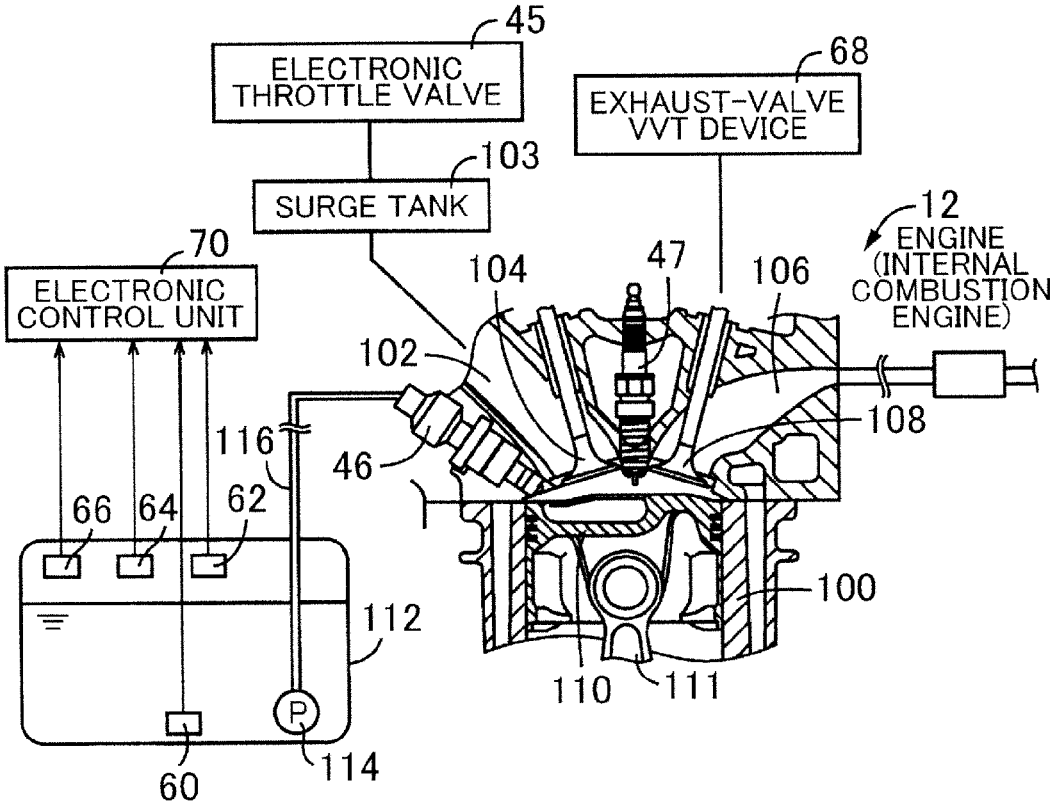
FIG. 2 is a view more specifically showing the configuration of an engine of FIG. 1.

The above-mentioned engine 12 is, for example, a six-cylinder, four-cycle gasoline engine. As specifically shown in FIG. 2, high-pressure fine particles of gasoline are directly injected from a fuel injection device 46 (injector) into each cylinder 100 of the engine 12. In the engine 12, air is drawn from an intake passage 102 into the cylinder 100 via an intake valve 104, and exhaust gas is discharged from an exhaust passage 106 via an exhaust valve 108. An air-fuel mixture in the cylinder 100 explodes and burns when it is ignited by an ignition device 47 in specified timing, so that a piston 110 is pushed downward. The intake passage 102 is connected to an electronic throttle valve 45 as an intake air flow control valve via a surge tank 103, and the amount of intake air flowing from the intake passage 102 into the cylinder 100, or the engine output, is controlled according to the opening (throttle opening) of the electronic throttle valve 45. The exhaust valve 108 is opened and closed via an exhaust-valve VVT device 68. The exhaust-valve VVT device 68 is a variable valve timing device that makes the opening timing of the exhaust valve 108 variable, and changes the opening timing of the exhaust valve 108 according to a signal from an electronic control unit 70 (see FIG. 1).

The above-mentioned piston 110 is axially slidably fitted in the cylinder 100, and is operatively coupled to a crankshaft (not shown) via a connecting rod 111. The crankshaft is rotated or driven in accordance with linear reciprocating motion of the piston 110.

The fuel stored in a fuel tank 112 is pumped up by a pump 114, and supplied to the fuel injection device 46 via a delivery pipe 116. In the fuel tank 112, a fuel temperature sensor 60 that detects the temperature Tfuel of the fuel, a fuel pressure sensor 62 that detects the pressure Pfuel in the fuel tank 112, a vapor pressure sensor 64 that detects the vapor pressure RVP of the fuel, and a fuel concentration sensor 66 that detects the fuel concentration Df (vaporization proportion) in the fuel tank 112 are installed.

Referring back to FIG. 1, a K0 clutch 34 that directly connects the engine 12 with the motor-generator MG is provided between the engine 12 and the motor-generator MG, via a damper 38. The K0 clutch 34 is a single-disc-type or multiple-disc-type friction clutch that is frictionally engaged by a hydraulic cylinder, and its engagement and release are controlled by a hydraulic control unit 28. The K0 clutch 34 is a hydraulic friction device, and functions as a connecting/disconnecting device that connects or disconnects the engine 12 to or from a power transmission pathway. The motor-generator MG is connected to a battery 44 via an inverter 42. The automatic transmission 20 is a stepwise variable automatic transmission of a planetary gear type, or the like, having two or more gear positions having different speed ratios. In operation, a selected one of the gear positions is established by selectively engaging or releasing any of two or more hydraulic friction devices (such as a clutch and a brake). Shift control of the automatic transmission 20 is performed by means of electromagnetically operated hydraulic control valves, switching valves, or the like, provided in the hydraulic control unit 28. The C1 clutch 18 functions as an input clutch of the automatic transmission 20, and its engagement and release are also controlled by the hydraulic control unit 28.

The vehicle 10 as described above is controlled by the electronic control unit 70. The electronic control unit 70 includes a so-called microcomputer having CPU, ROM, RAM, and input and output interfaces, and performs signal processing according to programs stored in advance in the ROM, utilizing the temporary storage function of the RAM. A signal indicative of the amount of operation of the accelerator pedal (accelerator operation amount) is supplied from an accelerator operation amount sensor 48. Also, signals concerning the rotational speed (engine speed) Ne of the engine 12, rotational speed (MG speed) Nmg of the motor-generator MG, rotational speed (turbine speed) Nt of the turbine shaft 16, rotational speed Nout of an output shaft 22 corresponding to the vehicle speed V, engine coolant temperature Tw, temperature Tf of the fuel in the fuel tank 112, pressure Pf in the fuel tank 112, vapor pressure RVP of the fuel, and the fuel concentration Df (vaporization proportion) in the fuel tank 112 are supplied from an engine speed sensor 50, MG speed sensor 52, turbine speed sensor 54, vehicle speed sensor 56, engine coolant temperature sensor 58, fuel temperature sensor 60, fuel pressure sensor 62, vapor pressure sensor 64, and fuel concentration sensor 66. In addition, various kinds of information required for various controls are supplied to the electronic control unit 70.

The electronic control unit 70 functionally includes a hybrid control unit 72, engine control unit 73, shift control unit 74, engine start/stop determining unit 76, and a start-time fuel injection amount setting unit 78. The hybrid control unit 72 controls the operation of the engine 12 and the motor-generator MG, so as to run the vehicle in one of a plurality of predetermined running modes, which is selected according to operating conditions, such as the accelerator operation amount Acc, and vehicle speed V. The running modes include an engine running mode in which the vehicle runs using only the engine 12 as a source of driving force, a motor running mode in which the vehicle runs using only the motor-generator MG as a source of driving force, and an engine+motor running mode in which the vehicle runs using both the engine 12 and the motor-generator MG as sources of driving force.

The engine control unit 73 calculates the required driving force Tr, based on the actual accelerator pedal position Acc (or the throttle opening θth) and the vehicle speed V, from a driving force map obtained and stored in advance, using running conditions, such as the accelerator pedal position (or the throttle opening θth) and the vehicle speed V, as variables. The engine control unit 73 further calculates engine torque Te to be generated by the engine 12, in view of the speed ratio, etc. of the automatic transmission 20. Then, the engine control unit 73 outputs command signals to the engine 12, so that the calculated engine torque Te can be obtained. More specifically, the engine control unit 73 outputs a throttle opening signal for driving a throttle actuator for controlling the throttle opening θth of the electronic throttle valve 45, an ignition signal for controlling the fuel injection amount M as the amount of fuel injected from the fuel injection device 46, an ignition timing signal for controlling the ignition timing of the engine 12 by the ignition device 47, and so forth, so that the calculated engine torque Te can be obtained.

The shift control unit 74 switches engagement/release states of the two or more hydraulic friction devices, by controlling electromagnetically-operated hydraulic control valves, switching valves, etc. provided in the hydraulic control unit 28, so as to establish a selected one of the two or more gear positions of the automatic transmission 20, according to a predetermined shift map using operating conditions, such as the accelerator operation amount Acc, vehicle speed V, etc. as parameters.

The engine start/stop determining unit 76 determines whether the engine 12 is to be stopped, depending on whether a given condition for automatically stopping the engine 12 is satisfied. For example, it is determined that a given condition for automatically stopping the engine 12 is satisfied when coasting is started upon release of the accelerator pedal or deceleration is started upon depression of the brake pedal, during running in the engine+motor running mode or the engine running mode, or when the vehicle is in a stopped state, or when running conditions of the vehicle enter a running region for switching from the engine running mode to the motor running mode. If the above-indicated given condition is satisfied, the engine start/stop determining unit 76 determines that the engine 12 is to be automatically stopped; in turn, the hybrid control unit 72 releases the K0 clutch 34 so as to disconnect the engine 12 from the power transmission pathway, and the engine control unit 73 stops fuel injection from the fuel injection device 46 (fuel-cut), and stops ignition control of the ignition device 47 so as to automatically stop the engine 12.

While the engine 12 is stopped, the engine start/stop determining unit 76 determines whether the engine 12 is to be started (re-started), depending on whether a given condition for starting or re-starting the engine 12 is satisfied. For example, it is determined that a given condition for starting (re-starting) the engine 12 is satisfied when the running conditions of the vehicle enter a running region for switching from the motor running mode to the engine running mode or engine+motor running mode, based on the accelerator pedal position Acc, vehicle speed V, etc. during running, or when the remaining power of the battery 44 becomes equal to or lower than a preset lower limit value, during running in a running region of the motor running mode. If the above-indicated given condition is satisfied, the engine start/stop determining unit 76 determines that the engine 12 is to be started (re-started), and, in the direct-injection engine, fuel is injected into and ignited in a cylinder that is stopped in the expansion stroke, so as to be exploded while the engine is at rest, so as to provide starting torque. The hybrid control unit 72 causes slipping engagement of the K0 clutch 34 so as to raise the engine speed Ne using torque of the motor-generator MG. With the explosion occurring while the engine is at rest, torque required to start the engine can be reduced.

When the engine is started or re-started, the start-time fuel injection amount setting unit 78 (which will be simply called "fuel injection amount setting unit 78") optimally sets the fuel injection amount M as the amount of fuel injected from the fuel injection device 46, so as to keep the engine start timing constant and prevent deterioration of the drivability. The fuel injection amount setting unit 78 corresponds to the fuel injection amount setting means of the invention.

Figure 3A:
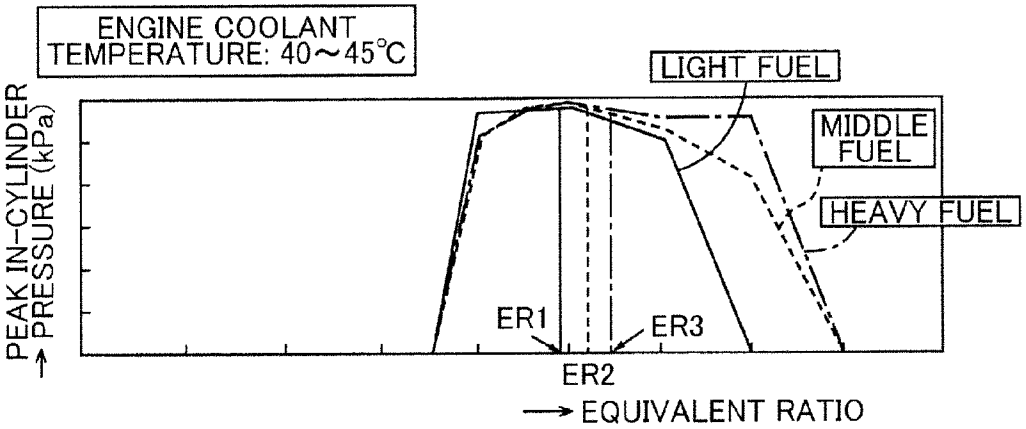
FIG. 3A is a view showing the required range of initially exploded fuel at the start of firing for each fuel property when the engine coolant temperature is in a low range.
Figure 3B:
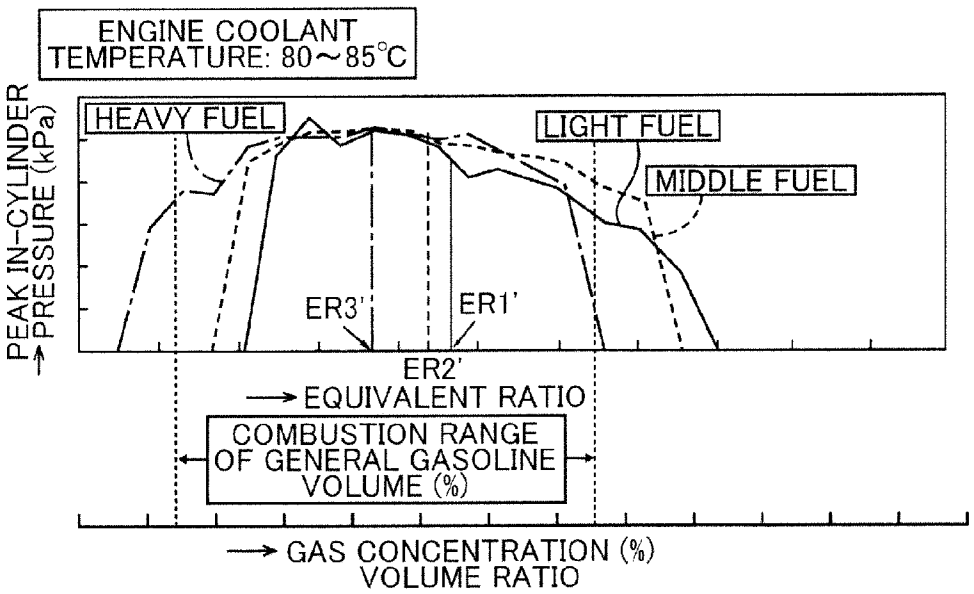
FIG. 3B is a view showing the required range of initially exploded fuel at the start of firing for each fuel property when the engine coolant temperature is in a high range.

FIG. 3A and FIG. 3B show the required range of initially exploded fuel at the start of firing for each fuel property. In FIG. 3A and FIG. 3B, the horizontal axis indicates the equivalent ratio (the ratio of the fuel actually supplied, to the amount of fuel equivalent to that of oxygen in air used for combustion), and the vertical axis indicates the peak in-cylinder pressure in the cylinder. Further, the solid line indicates light fuel, and the broken line indicates middle fuel, while the one-dot chain line indicates heavy fuel. Also, FIG. 3A shows conditions where the engine coolant temperature Tw is in the range of 40-45° C., and FIG. 3B shows conditions where the engine coolant temperature Tw is in the range of 80-85° C.

As shown in FIG. 3A and FIG. 3B, no matter whether the fuel is light fuel, middle fuel, or heavy fuel, the average value of the equivalent ratio when the engine coolant temperature Tw is high (80-85° C.) is smaller than that when the engine coolant temperature Tw is low (40-45° C.). More specifically, ER1 denotes the average value of the equivalent ratio of the light fuel when the engine coolant temperature Tw is low, ER2 denotes the average value of the equivalent ratio of the middle fuel when the engine coolant temperature Tw is low, and ER3 denotes the average value of the equivalent ratio of the heavy fuel when the engine coolant temperature Tw is low (see FIG. 3A). Also, ER1' denotes the average value of the equivalent ratio of the light fuel when the engine coolant temperature Tw is high, ER2' denotes the average value of the equivalent ratio of the middle fuel when the engine coolant temperature Tw is high, and ER3' denotes the average value of the equivalent ratio of the heavy fuel when the engine coolant temperature Tw is high (see FIG. 3B). As is understood from FIG. 3A and FIG. 3B, ER1 obtained at a low temperature is larger than ER1' obtained at a high temperature, and ER2 obtained at a low temperature is larger than ER2' obtained at a high temperature, while ER3 obtained at a low temperature is larger than ER3' obtained at a high temperature. Thus, no matter whether the fuel is light fuel, middle fuel, or heavy fuel, the equivalent ratio of the fuel at a low temperature is larger than that of the fuel at a high temperature. Since the proportion of the fuel is higher as the equivalent ratio is larger, the required fuel amount M (i.e., the fuel injection amount M) of the fuel to be injected from the fuel injection device 46 is increased. Accordingly, irrespective of the fuel property, the required fuel amount M (namely, the fuel injection amount M) is reduced as the engine coolant temperature Tw is higher.

As shown in FIG. 3A, when the engine coolant temperature Tw is in a low temperature range (40° C.-45° C.), the light fuel has the lowest average value ER1 of the equivalent ratio, and the average value ER2 of the equivalent ratio of the middle fuel is higher than the average value ER1 of that of the light fuel, while the average value ER3 of the equivalent ratio of the heavy fuel is higher than the average value ER2 of that of the middle fuel (ER1<ER2<ER3). In other words, when the engine coolant temperature Tw is low, the required fuel amount M3 of the heavy fuel is largest, and the required fuel amount M2 of the middle fuel is the second largest, while the required fuel amount M1 of the light fuel is smallest (M1<M2<M3). On the other hand, as shown in FIG. 3B, when the engine coolant temperature Tw is in a high temperature range (80° C.-85° C.), the light fuel has the highest average value ER1' of the equivalent ratio, and the average value ER2' of the equivalent ratio of the middle fuel is lower than the average value ER1' of that of the light fuel, while the average value ER3' of the equivalent ratio of the heavy fuel is lower than the average value ER2' of that of the middle fuel (ER3'<ER2'<ER1'). In other words, when the coolant temperature Tw is high, the required fuel amount M1 of the light fuel is largest, and the required fuel amount M2 of the middle fuel is the second largest, while the required fuel amount M3 of the heavy fuel is smallest (M3<M2<M1). Thus, the required fuel amount M varies depending on the fuel property, in opposite fashions between the time when the engine coolant temperature Tw is low, and the time when it is high.

The reason why the required fuel amount M varies depending on the fuel property, in opposite fashions between the time when the engine coolant temperature Tw is low, and the time when it is high, will be described. While the temperature in the cylinder (in-cylinder temperature) will be mentioned in the following description, the in-cylinder temperature may be referred to as the engine coolant temperature since the in-cylinder temperature is proportional to the engine coolant temperature Tw. In the process of burning of the fuel, the fuel is formed into fine particles due to shear force produced against air when the fuel is injected from the fuel injection device 46, and further vaporized depending on the temperature in the cylinder (in-cylinder temperature). Then, the vaporized fuel is burned (fired) due to a spark of the ignition device 47. Namely, it is important that the fuel is vaporized. Since the light fuel has a high vapor pressure RVP and is likely to be vaporized, it is likely to be burned even if the in-cylinder temperature is low. Thus, since the light fuel is likely to be burned even if the in-cylinder temperature is low, the required fuel amount M may be small when the in-cylinder temperature is low. To the contrary, the heavy fuel has a low vapor pressure RVP and is less likely to be vaporized if the in-cylinder temperature is small; therefore, the required fuel amount M needs to be increased when the in-cylinder temperature is low, so as to assure sufficiently high combustibility.

On the other hand, if the in-cylinder temperature becomes high, the fuel injected into the cylinder is sufficiently vaporized even if it is heavy fuel. Accordingly, when the in-cylinder temperature is high, the likelihood of the fuel to vaporize does not substantially matter. Here, the process of burning of the vaporized fuel (gasoline) will be further described. The temperature of the vaporized gasoline locally becomes extremely high due to a spark of the ignition device 47, so that the gasoline decomposes, and hydrocarbon molecules resulting from the decomposition chemically react with oxygen, so as to generate heat. The hydrocarbon molecules are further decomposed by the heat thus generated, and chemically react with oxygen. The chain of these chemical reactions results in combustion, and flame propagates radially from the ignition device 47. Since the gasoline is already vaporized when the in-cylinder temperature is high, the required fuel amount M at this time is determined by the likelihood of molecules of gasoline itself to be decomposed. Since hydrocarbon molecules are formed to be long and large in the heavy fuel, for example, the molecules are likely to be flawed and decomposed. In the light fuel, on the other hand, hydrocarbon molecules are short and small; therefore, the molecules are firmly linked together, and are less likely or unlikely to be decomposed. Namely, in the vaporized condition, the heavy fuel is more likely to be decomposed and burned as compared with the light fuel. Accordingly, when the in-cylinder temperature is high, the required fuel amount M of the heavy fuel may be smaller than that of the light fuel.

Generally, the fuel has two characteristics, i.e., the flash temperature and the ignition temperature. The flash temperature is a temperature at which the fuel burns when a small flame is brought close to the fuel, and is substantially equivalent to the vaporization temperature of the fuel. Namely, the fuel is more likely to be vaporized as the flash temperature is lower. The ignition temperature is a temperature at which the fuel ignites by itself (molecule chains are dissolved or broken down, resulting in continuous oxidation), and the ignition temperature is higher than the flash temperature. For example, the flash temperature of gasoline is equal to or lower than −43° C., and the ignition temperature is about 300° C. Also, the flash temperature of heavy oil is about 60-100° C., and the ignition temperature is about 225° C. Thus, the flash temperature is lower as the fuel is more likely to be vaporized (as in the case of light fuel), and the ignition temperature is lower as the fuel is less likely to be vaporized (as in the case of heavy fuel). The ignition temperature of the heavy fuel is lower than that of the light fuel, because the light fuel is composed of short molecular chains, which are tightly or rigidly linked together, thus requiring a higher temperature for dissolution, whereas the heavy fuel is composed of long molecular chains, which are more easily dissolved. Accordingly, even where the same gasoline is used, the required fuel amount M of the heavy fuel having a low vaporization pressure needs to be increased for combustion, due to poor ability to vaporize, when the in-cylinder temperature is low, whereas the required fuel amount M of the heavy fuel needs to be reduced when the in-cylinder temperature is high, since the fuel is sufficiently vaporized and is likely to be decomposed (burned). It follows that the required fuel amount M varies depending on the fuel property, in opposite fashions between the time when the in-cylinder temperature is low, and the time when it is high.

Figure 4:
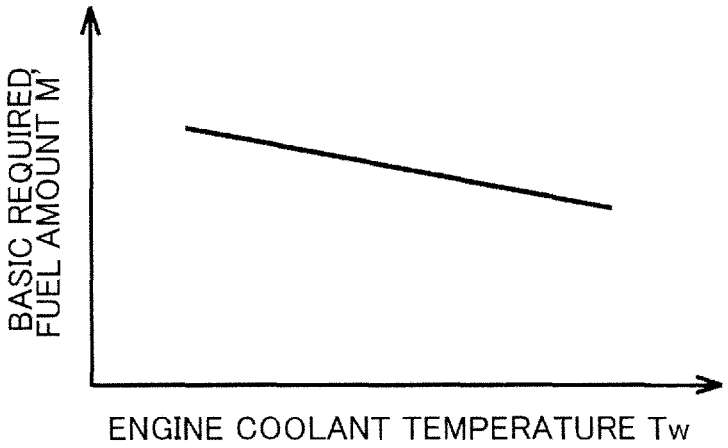
FIG. 4 is a map used for determining a required fuel amount based on an engine coolant temperature.

In view of the above description, the fuel injection amount setting unit 78 controls the required fuel amount M (fuel injection amount M) so that the required fuel amount M decreases as the engine coolant temperature Tw is higher. Although the fuel is actually burned in each cylinder of the engine 12, and the combustibility of the fuel is directly influenced by the in-cylinder temperature, it is difficult to directly detect the in-cylinder temperature. Thus, in this embodiment, the in-cylinder temperature is estimated based on the engine coolant temperature Tw proportional to the in-cylinder temperature, as a value associated with the in-cylinder temperature. The fuel injection amount setting unit 78 indirectly estimates the in-cylinder temperature based on the engine coolant temperature Tw, and determines the basic required fuel amount M' from the actual engine coolant temperature Tw, based on a map as shown in FIG. 4, which indicates the relationship between the engine coolant temperature Tw and the basic required fuel amount M'. As shown in FIG. 4, the basic required fuel amount M' is set to be smaller as the engine coolant temperature Tw is higher. This is because, as the engine coolant temperature Tw is higher, namely, as the in-cylinder temperature in the cylinder of the engine 12 is higher, the vaporization proportion of the fuel is increased, and the fuel becomes more likely to be burned.

Figure 5A:
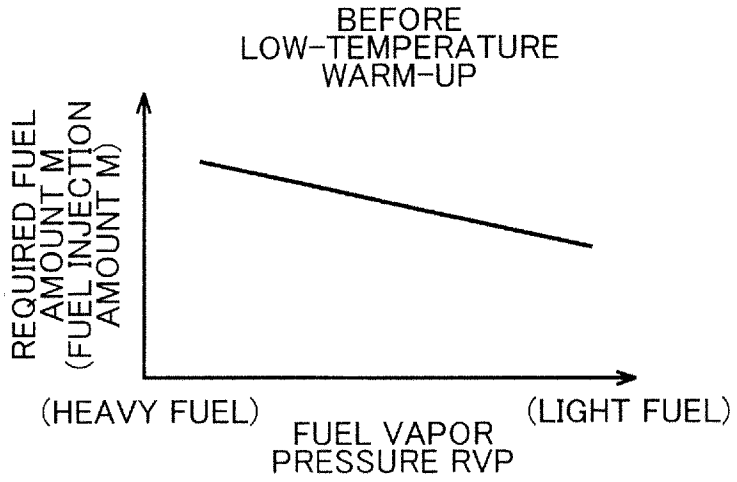
FIG. 5A is a map indicating the tendency of the required fuel amount based on the vapor pressure of the fuel before low-temperature warm-up.
Figure 5B:
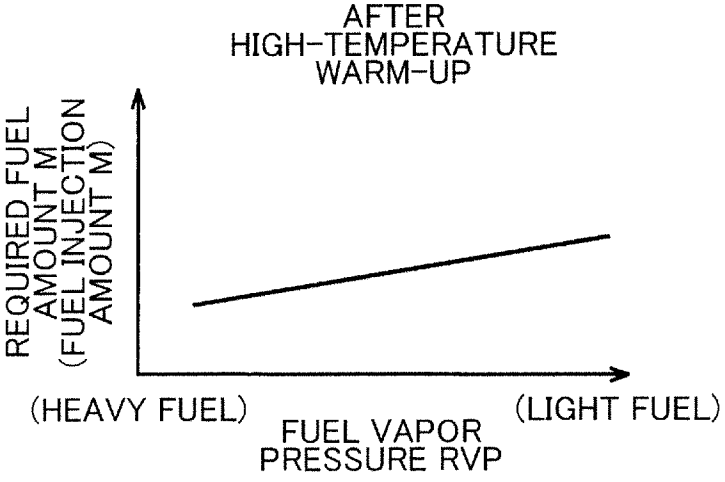
FIG. 5B is a map indicating the tendency of the required fuel amount based on the vapor pressure of the fuel after high-temperature warm-up.

The relationship between the vapor pressure RVP (corresponding to the fuel property) of the fuel and the required fuel amount M (i.e., the fuel injection amount M) is shown in FIG. 5A and FIG. 5B. FIG. 5A indicates the relationship to be used when the in-cylinder temperature is low (before low-temperature warm-up), and FIG. 5B indicates the relationship to be used when the in-cylinder temperature is high (after high-temperature warm-up). In FIG. 5A and FIG. 5B, the horizontal axis indicates the vapor pressure RVP of the fuel, and the vertical axis indicates the required fuel amount M (fuel injection amount M). As shown in FIG. 5A, where the in-cylinder temperature is low, the required fuel amount M is reduced as the vapor pressure RVP is higher, namely, as the fuel is lighter. Namely, the rate of change of the fuel injection amount M relative to the vapor pressure RVP is negative. This is because, at low temperatures, the fuel is more likely to be vaporized and burned as the vapor pressure RVP is higher (as the fuel is lighter). Also, as shown in FIG. 5B, where the in-cylinder temperature is high, the required fuel amount M is increased as the vapor pressure RVP is higher, namely, as the fuel is lighter. Namely, the rate of change of the fuel injection amount M relative to the vapor pressure RVP is positive. This is because, at high temperatures, the fuel is sufficiently vaporized irrespective of the fuel property, and the hydrocarbon molecules are less likely to be decomposed as the vapor pressure RVP is higher, thus making it necessary to increase the required fuel amount M.

Thus, the fuel injection amount setting unit 78 stores the relationship between the fuel vapor pressure RVP and the fuel injection amount M, based on the engine coolant temperature Tw, and the rate of change of the fuel injection amount M relative to the vapor pressure RVP is set to be larger as the engine coolant temperature Tw is higher. For example, the rate of change of the fuel injection amount M relative to the vapor pressure RVP is negative when the in-cylinder temperature is low (before low-temperature warm-up) as shown in FIG. 5A, and the rate of change of the fuel injection amount M relative to the vapor pressure RVP is positive when the in-cylinder temperature is high (after high-temperature warm-up) as shown in FIG. 5B. Namely, as the engine coolant temperature Tw is higher, the rate of change of the fuel injection amount M relative to the vapor pressure RVP changes from negative to positive, in other words, the rate of change of the fuel injection amount M relative to the vapor pressure RVP is increased.

Figure 6A:
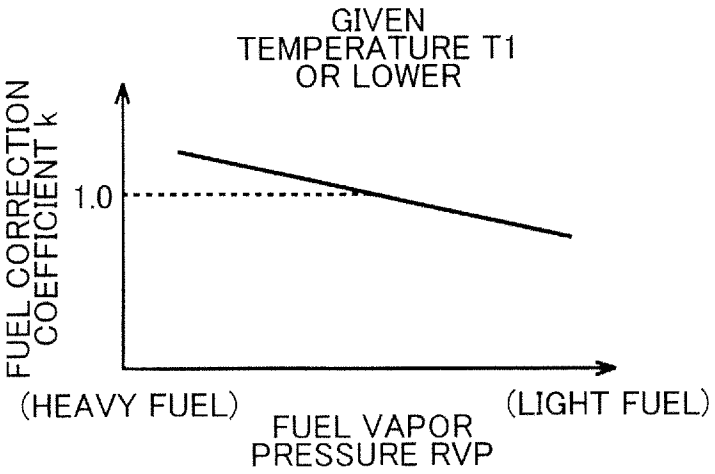
FIG. 6A is a map used for determining the fuel correction coefficient based on the vapor pressure of the fuel when the engine coolant temperature is equal to or lower than the given temperature.
Figure 6B:
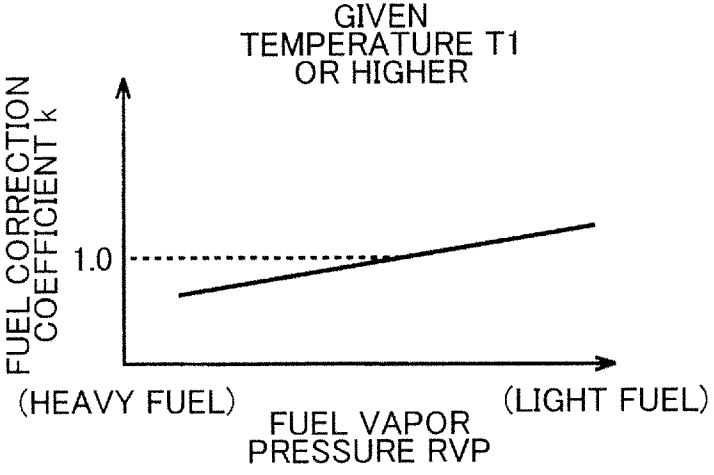
FIG. 6B is a map used for determining the fuel correction coefficient based on the vapor pressure of the fuel when the engine coolant temperature exceeds the given temperature.

Initially, the fuel injection amount setting unit 78 detects the engine coolant temperature Tw in place of the in-cylinder temperature, and determines whether the engine coolant temperature Tw exceeds a preset given temperature T1. The given temperature T1 is set in advance based on experiments, or the like. For example, the given temperature T1 is set to a temperature T50 at which about 50% of the fuel is vaporized in the cylinder. The fuel injection amount setting unit 78 stores required fuel amount correction maps showing different tendencies as indicated in FIG. 6A and FIG. 6B, between the case where the engine coolant temperature Tw is equal to or lower than the given temperature T1, and the case where the engine coolant temperature Tw exceeds the given temperature T1. The fuel injection amount setting unit 78 selects one of the required fuel amount correction maps, based on the engine coolant temperature Tw, and sets a fuel correction coefficient k based on the map. In FIG. 6A and FIG. 6B, the horizontal axis indicates the vapor pressure RVP, and the vertical axis indicates the fuel correction coefficient k corresponding to the fuel injection amount M. In FIG. 6A, when the engine coolant temperature Tw is equal to or lower than the given temperature T1 (before low-temperature warm-up in FIG. 5A), the fuel correction coefficient k is reduced as the vapor pressure RVP is higher, as in FIG. 5A. In other words, the fuel correction coefficient k is set so that the rate of change of the fuel injection amount M relative to the vapor pressure RVP becomes negative. Also, in FIG. 6B, when the engine coolant temperature Tw exceeds the given temperature T1 (after high-temperature warm-up in FIG. 5B), the fuel correction coefficient k is increased as the vapor pressure RVP is higher, as in FIG. 5B. In other words, the fuel correction coefficient k is set so that the rate of change of the fuel injection amount M relative to the vapor pressure RVP becomes positive. The fuel injection amount setting unit 78 detects the vapor pressure RVP of the fuel, and determines the fuel correction coefficient k based on the detected vapor pressure RVP, from the required fuel amount correction map determined based on the engine coolant temperature Tw. Then, the fuel injection amount setting unit 78 calculates the required fuel amount M, by multiplying the basic required fuel amount M' obtained in advance based on the map of FIG. 4 by the determined fuel correction coefficient k. In this manner, where the engine coolant temperature Tw is equal to or lower than the given temperature T1, the required fuel amount M' is corrected to be reduced when the vapor pressure RVP is high (the fuel is relatively light), and the required fuel amount M' is corrected to be increased when the vapor pressure RVP is low (the fuel is relatively heavy). On the other hand, when the engine coolant temperature Tw is higher than the given temperature T1, the required fuel amount M' is corrected to be increased when the vapor pressure RVP is high, and the required fuel amount M' is corrected to be reduced when the vapor pressure RVP is low. The required fuel amount correction map as shown in FIG. 6A corresponds to the first map used for determining the fuel injection amount when the temperature in the cylinder is equal to or lower than a predetermined temperature according to the invention, and the required fuel amount correction map as shown in FIG. 6B corresponds to the second map used when the temperature in the cylinder exceeds the predetermined temperature according to the invention.

The vapor pressure RVP of the fuel may be directly detected by the vapor pressure sensor 64, for example, or the vapor pressure RVP may be calculated based on the actually detected fuel temperature Tf and internal pressure Pf in the fuel tank 112, from a map indicating the relationship of the vapor pressure RVP with the fuel temperature Tf and the internal pressure Pf, which relationship is experimentally obtained in advance. In another example, the rate of increase of rotational speed ΔNe as the rate of change of the engine speed Ne at the time of cold start may be calculated, and the vapor pressure RVP may be obtained with reference to the calculated rate of increase of rotational speed ΔNe, from a map indicating the relationship between the vapor pressure RVP and the rate of increase of rotational speed ΔNe, which relationship is experimentally obtained in advance.

As another method of obtaining the required fuel amount M, the fuel injection amount setting unit 78 may store a plurality of maps (corresponding to FIG. 5A and FIG. 5B) indicating the relationship between the vapor pressure RVP and the required fuel amount M for each engine coolant temperature Tw, and determine the required fuel amount M based on the vapor pressure RVP, from a selected one of the maps corresponding to the detected engine coolant temperature Tw. In the maps, the slope of the line indicating the above relationship switches between an increasing or positive slope and a decreasing or negative slope, with respect to the given temperature T1 as a boundary. More specifically, when the engine coolant temperature Tw is equal to or lower than the given temperature T1, the required fuel amount M tends to be reduced (see FIG. 5A) as the vapor pressure RVP increases, namely, the rate of change of the fuel injection amount M relative to the vapor pressure RVP is negative: however, the rate of change (slope) is reduced (becomes shallower) as the engine coolant temperature Tw increases. When the engine coolant temperature Tw exceeds the given temperature T1, the decreasing slope is switched to an increasing slope along which the required fuel amount M increases as the vapor pressure RVP increases (see FIG. 5B). Namely, the rate of change of the fuel injection amount M relative to the vapor pressure RVP becomes positive.

When the engine is started, the engine control unit 73 causes the fuel injection device 46 to inject the fuel in the required fuel amount M determined by the fuel injection amount setting unit 78, so that the fuel is fired in a stable condition in the cylinder, and the start timing of the engine 12 is made substantially constant.

Figure 7:
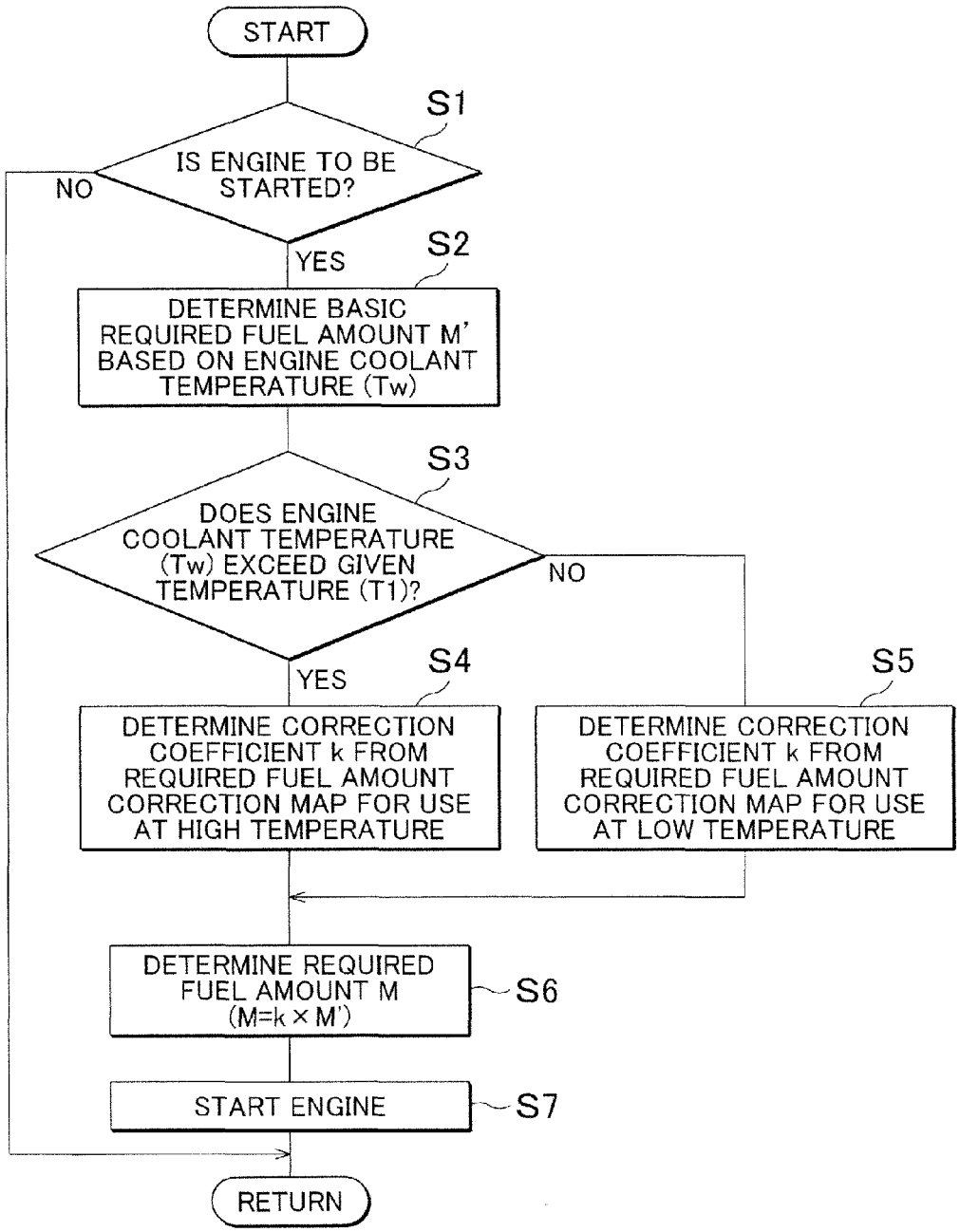
FIG. 7 is a flowchart illustrating a principal part of control operation of an electronic control unit of FIG. 1, namely, control operation for making the start timing of the engine constant and curbing deterioration of drivability, by setting the fuel injection amount as the amount of fuel injected from a fuel injection device to the optimum value, when the engine is started from a condition where the engine is stopped.

FIG. 7 is a flowchart illustrating a principal part of control operation of the electronic control unit 70, namely, control operation for making the start timing of the engine 12 constant and curbing deterioration of the drivability, by setting the fuel injection amount M as the amount of fuel injected from the fuel injection device 46 to the optimum value, when the engine 12 is started from a condition where the engine is stopped. The flowchart is repeatedly executed at extremely short intervals of, for example, several milliseconds to several tens of milliseconds.

Initially, it is determined in step S1 corresponding to the engine start/stop determining unit 76 whether the engine 12 is to be started. If a negative decision (NO) is obtained in step S1, the current cycle of this routine ends. If an affirmative decision (YES) is obtained in step S1, the basic required fuel amount M' is determined based on the engine coolant temperature Tw, from the map of FIG. 4, in step S2 corresponding to the fuel injection amount setting unit 78. Then, in step S3 corresponding to the fuel injection amount setting unit 78, it is determined whether the engine coolant temperature Tw exceeds a preset given temperature T1. If an affirmative decision (YES) is obtained in step S3, the fuel correction coefficient k is determined based on the vapor pressure RVP, from the required fuel amount correction map shown in FIG. 6B, which is used in the case where the engine coolant temperature Tw exceeds the given temperature T1 (where the temperature is high), in step S4 corresponding to the fuel injection amount setting unit 78. In the required fuel amount correction map used in the case where the engine coolant temperature Tw exceeds the given temperature T1, the fuel correction coefficient k increases as the vapor pressure RVP increases. Namely, the rate of change of the fuel injection amount M relative to the vapor pressure RVP is positive. If a negative decision (NO) is obtained in step S3, the fuel correction coefficient k is determined based on the required fuel amount correction map shown in FIG. 6A, which is used in the case where the engine coolant temperature Tw is equal to or lower than the given temperature T1 (where the temperature is low), in step S5 corresponding to the fuel injection amount setting unit 78. In the required fuel amount correction map used in the case where the engine coolant temperature Tw is equal to or lower than the given temperature T1, the fuel correction coefficient k decreases as the vapor pressure RVP increases. Namely, the rate of change of the fuel injection amount M relative to the vapor pressure RVP is negative. In step S6 corresponding to the fuel injection amount setting unit 78, the required fuel amount M is determined by multiplying the basic required fuel amount M' obtained in step S2, by the fuel correction coefficient k determined in step S4 or step S5. Then, in step S7 corresponding to the engine control unit 73, the engine is started, and the fuel is injected in the required fuel amount M determined in step S6 upon engine starting, so that the start timing of the engine 12 is kept constant, and deterioration of the drivability is curbed.

As described above, according to this embodiment, the relationship between the vapor pressure RVP and the fuel injection amount M is set, based on the temperature in the cylinder of the engine 12, and the rate of change of the fuel injection amount M relative to the vapor pressure RVP is set to be large as the in-cylinder temperature is higher. The rate of change of the fuel injection amount M relative to the vapor pressure RVP is increased as the in-cylinder temperature is higher, in view of the fact that the start timing of the engine 12 is more influenced by the combustibility of the fuel than the likelihood of the fuel to vaporize as the in-cylinder temperature is higher, so that the optimum fuel injection amount M that makes the start timing of the engine 12 constant irrespective of the fuel property of the fuel is set. Thus, the start timing of the engine 12 is kept constant irrespective of the fuel property, so that deterioration of the drivability can be curbed or reduced.

Also, according to this embodiment, the rate of change of the fuel injection amount M relative to the vapor pressure RVP is positive when the engine coolant temperature Tw is equal to or higher than the given temperature T1. Thus, when the engine coolant temperature Tw is equal to or higher than the given temperature T1, the fuel injection amount M increases as the vapor pressure RVP increases, and the fuel injection amount M of the light fuel having a high vapor pressure RVP and low combustibility increases. It is thus possible to keep the start timing of the engine 12 constant, by increasing the fuel injection amount of the light fuel having low combustibility.

Also, according to this embodiment, one of the required fuel amount correction map used when the engine coolant temperature Tw is equal to or lower than the given temperature T1, and the required fuel amount correction map used when the engine coolant temperature Tw exceeds the given temperature T1, is selected as appropriate based on the engine coolant temperature Tw. Thus, an appropriate one of the required fuel amount correction maps is selected, for the fuel injection amount M that varies in different fashions depending on whether the engine coolant temperature Tw is higher or lower than the given temperature T1, and the optimum fuel injection amount M can be determined, based on the correction map.

Also, according to this embodiment, since it is difficult to directly detect the in-cylinder temperature, the in-cylinder temperature is estimated from the engine coolant temperature Tw as a value associated with the in-cylinder temperature, and the optimum fuel injection amount M can be determined, based on the estimated in-cylinder temperature.

Next, another embodiment of the invention will be described. In the following description, the same reference numerals are assigned to the same or corresponding portions or elements as those of the above-described embodiment, and explanation of these portions or elements will not be provided.

Figure 8:
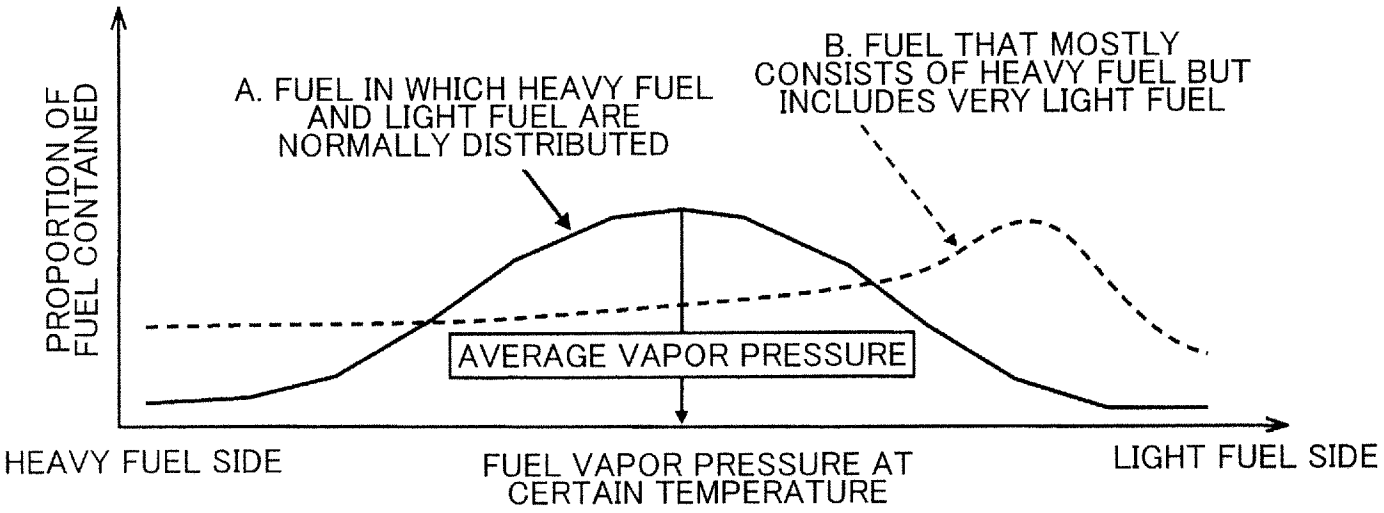
FIG. 8 is a view showing, by way of example, fuels having different contents of light fuel and heavy fuel though their average values of the vapor pressure are equal to each other, at a certain engine coolant temperature (or temperature in the cylinder)

In the above-described embodiment, the required fuel amount correction map that determines the fuel correction coefficient k is selected based on the engine coolant temperature Tw. In this embodiment, the required fuel amount correction map is selected based on the vaporization proportion of the fuel injected into the cylinder. Generally, gasoline is a mixture of multiple types of hydrocarbons, and the vaporization proportion may be different even if the vapor pressure RVP at a certain temperature is equal. FIG. 8 shows the proportion of different types of fuel contained in two types of fuel A, B at a certain engine coolant temperature Tw (or in-cylinder temperature). The fuel A contains light fuel and heavy fuel that are normally distributed therein, and the fuel B consists mostly of heavy fuel though it contains very light fuel as a part thereof. While the fuel A and the fuel B have the same average value of the vapor pressure RVP, they have different vaporization proportions since they have different proportions of fuel components. For example, since a large proportion of the fuel B is heavy fuel, the temperature T50 at which the vaporization proportion becomes equal to 50% is higher than the temperature T50 of the fuel A even if the average value of the vapor pressure RVP is equal. Thus, in this embodiment, the vaporization proportion of gasoline, rather than the engine coolant temperature Tw, is measured, and the required fuel amount correction map is selected based on the vaporization proportion.

Figure 9:
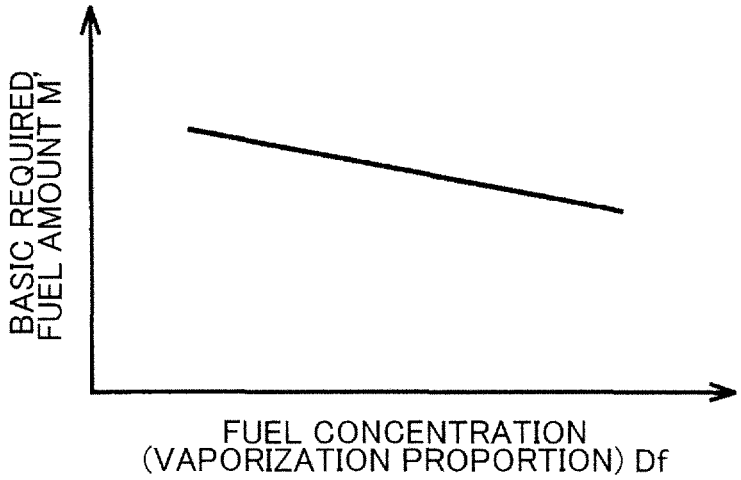
FIG. 9 is a map used for determining the required fuel amount based on the fuel concentration (vaporization proportion)

Initially, a start-time fuel injection amount setting unit 152 of this embodiment (the fuel injection amount setting means of the invention) determines the basic required fuel amount M', based on the map indicating the relationship between the engine coolant temperature Tw and the basic required fuel amount M' as shown in FIG. 4. Instead of the map of FIG. 4, a map indicating the relationship between the fuel concentration (i.e., vaporization proportion) Df and the basic required fuel amount M' as shown in FIG. 9 may be empirically obtained in advance, and the basic required fuel amount M' may be determined based on the fuel concentration Df detected by the fuel concentration sensor 66, from the map of FIG. 9.

Also, the start-time fuel injection amount setting unit 152 determines whether the detected fuel concentration Df or vaporization proportion exceeds 50% (corresponding to the predetermined value of the vaporization proportion according to the invention), for example. If it is determined that the fuel concentration (vaporization proportion) Df is equal to or lower than 50%, the fuel injection amount setting unit 152 determines the fuel correction coefficient k based on the vapor pressure RVP, from a required fuel amount correction map as shown in FIG. 10A. The required fuel amount correction map of FIG. 10A is substantially identical with that of the map of FIG. 6A. Accordingly, when the vaporization proportion of the fuel is equal to or lower than 50%, the required fuel amount M (the fuel injection amount M) increases as the vapor pressure RVP of the fuel is lower. Namely, the rate of change of the fuel injection amount M relative to the vapor pressure RVP is negative. The required fuel injection amount correction map as shown in FIG. 10A corresponds to the first map for determining the fuel injection amount, which map is used when the vaporization proportion of the fuel is equal to or smaller than the predetermined value according to the invention.

Figure 10B:
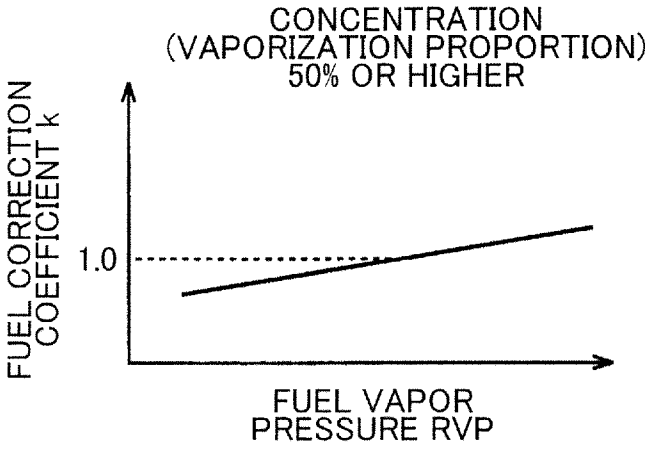
FIG. 10B is a map used for determining the required fuel amount based on the vapor pressure of the fuel when the vaporized proportion of the fuel exceeds the predetermined value.
Figure 10A:
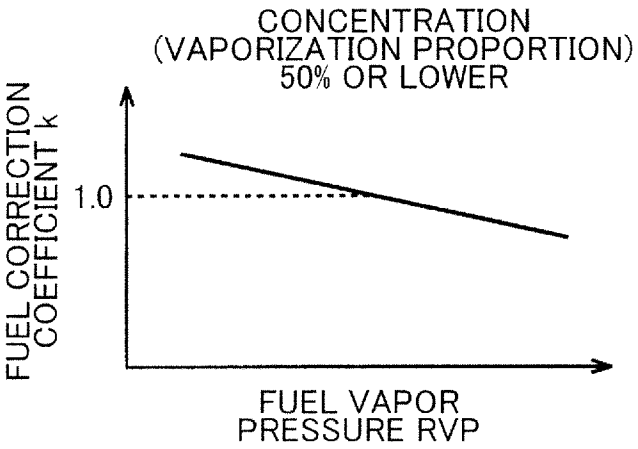
FIG. 10A is a map used for determining the required fuel amount based on the vapor pressure of the fuel when the vaporized proportion of the fuel is equal to or smaller than a predetermined value.

If, on the other hand, it is determined that the vaporization proportion exceeds 50%, the fuel injection amount setting unit 152 determines the fuel correction coefficient k based on the vapor pressure RVP, from a required fuel amount correction map as shown in FIG. 10B. The required fuel amount correction map of FIG. 10B is substantially identical with the map of FIG. 6B. Accordingly, when the vaporization proportion of the fuel exceeds 50%, the required fuel amount M (the fuel injection amount M) decreases as the vapor pressure RVP of the fuel is lower. Namely, the rate of change of the fuel injection amount M relative to the vapor pressure RVP is positive. The required fuel amount correction map as shown in FIG. 10B corresponds to the second map for determining the fuel injection amount, which map is used when the vaporization proportion of the fuel exceeds the predetermined value according to the invention.

Once the fuel correction coefficient k is determined, the fuel injection amount setting unit 152 determines the required fuel amount M, by multiplying the preset basic required fuel amount M', by the fuel correction coefficient k determined according to the required fuel amount correction map of FIG. 10A or FIG. 10B.

Figure 11:
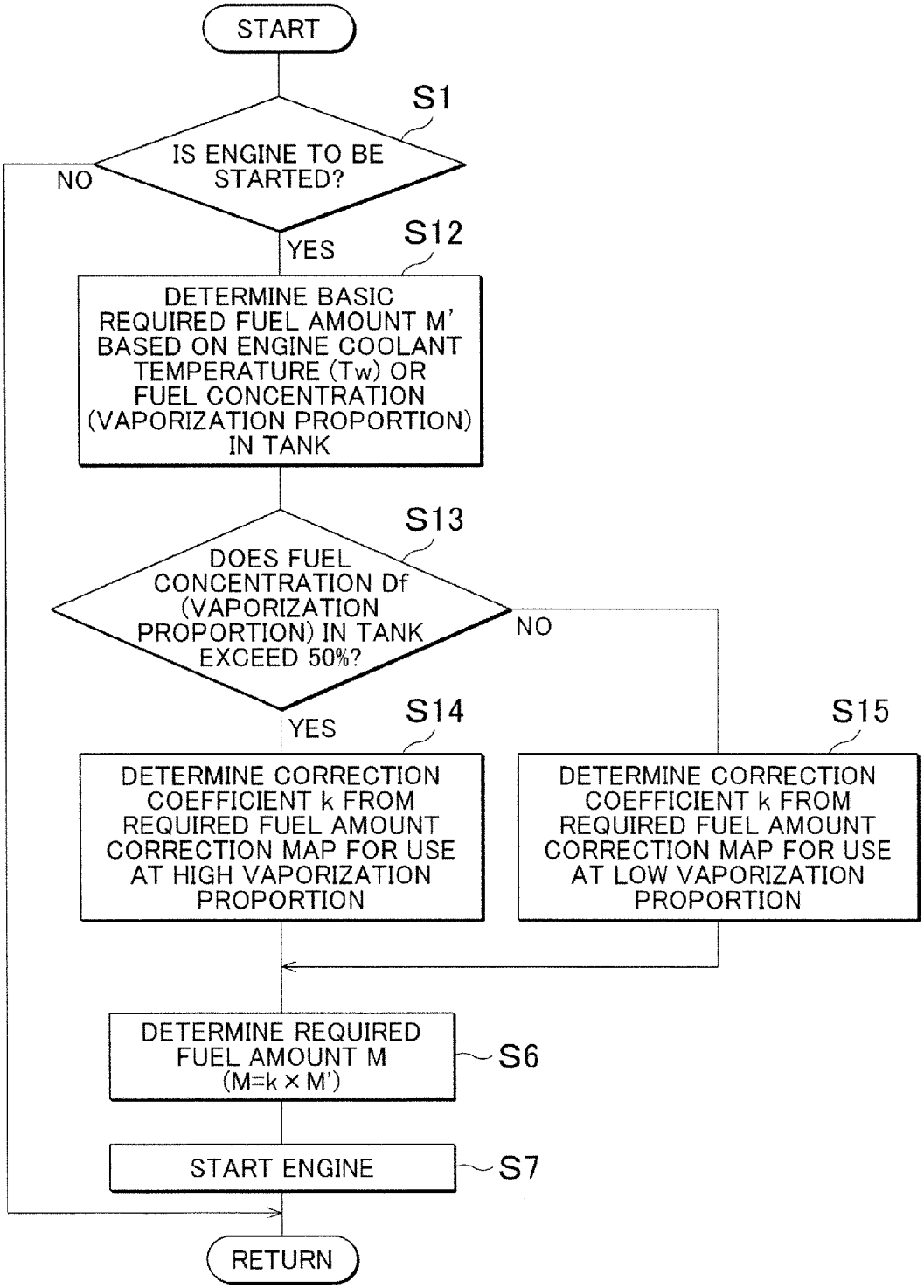
FIG. 11 is a flowchart illustrating a principal part of control operation of the electronic control unit, namely, control operation for making the start timing of the engine constant and curbing deterioration of the drivability, by setting the fuel injection amount as the amount of fuel injected from the fuel injection device to the optimum value, when the engine is started from a condition where the engine is stopped.

FIG. 11 is a flowchart illustrating a principal part of control operation of the electronic control unit 150 of this embodiment, namely, control operation for making the start timing of the engine 12 constant and curbing deterioration of the drivability, by setting the fuel injection amount M as the amount of fuel injected from the fuel injection device 46 to the optimum value, when the engine 12 is started from a condition where the engine is stopped.

Initially, it is determined in step S1 corresponding to the engine start/stop determining unit 76 whether the engine 12 is to be started. If a negative decision (NO) is obtained in step S1, the current cycle of this routine ends. If an affirmative decision (YES) is obtained in step S2, the required fuel amount M' is determined based on the engine coolant temperature Tw, from the map of FIG. 4, in step S12 corresponding to the fuel injection amount setting unit 152. Alternatively, the required fuel amount M' is determined based on the fuel concentration Df (vaporization proportion), from the map of FIG. 9. It is determined in step S13 corresponding to the fuel injection amount setting unit 152 whether the fuel concentration Df (vaporization proportion) exceeds 50%. If an affirmative decision (YES) is obtained in step S13, the fuel correction coefficient k is determined based on the actual vapor pressure RVP, from the required fuel amount correction map as shown in FIG. 10B, in step S14 corresponding to the fuel injection amount setting unit 152. If a negative decision (NO) is obtained in step S13, the fuel correction coefficient k is determined based on the actual vapor pressure RVP, from the required fuel amount correction map as shown in FIG. 10A, in step S15 corresponding to the fuel injection amount setting unit 152. In step S6 corresponding to the fuel injection amount setting unit 152, the required fuel amount M is determined by multiplying the basic required fuel amount M' determined in step S12, by the fuel correction coefficient k determined in step S14 or S15 ($M=k\times M'$). Then, in step S7 corresponding to the engine control unit 73, the engine is started, and the fuel is injected in the required fuel amount M determined in step S6 at the time of engine start, so that the start timing of the engine 12 is kept constant, and deterioration of the drivability is curbed or reduced.

As described above, according to this embodiment, the relationship between the vapor pressure RVP of the fuel and the fuel injection amount M is set, based on the concentration Df (vaporization proportion) of the fuel, and the rate of change of the fuel injection amount M relative to the vapor pressure RVP is set to be larger as the concentration Df (vaporization proportion) of the fuel is higher. The rate of change of the fuel injection amount M relative to the vapor pressure RVP is increased as the concentration Df (vaporization proportion) of the fuel is higher, in view of the fact that the start timing of the engine 12 is more influenced by the combustibility of the fuel than the likelihood of the fuel to vaporize as the fuel concentration Df becomes higher, so that the optimum fuel injection amount M that makes the start timing of the engine 12 constant irrespective of the fuel property is set. Thus, the start timing of the engine 12 is kept constant irrespective of the fuel property, so that deterioration of the drivability can be curbed or reduced.

Also, according to this embodiment, the rate of change of the fuel injection amount M relative to the vapor pressure RVP is positive when the concentration Df (vaporization proportion) of the fuel is equal to or higher than a predetermined value. Thus, when the concentration Df of the fuel is equal to or higher than 50%, the fuel injection amount M increases as the vapor pressure RVP increases, and the fuel injection amount M of the fuel having a high vapor pressure RVP and low combustibility increases. It is thus possible to keep the start timing of the engine 12 constant, by increasing the fuel injection amount M of the light fuel having low combustibility.

Also, according to this embodiment, the required fuel amount correction map used when the concentration Df (vaporization proportion) of the fuel is equal to or lower than 50%, and the required fuel amount correction map used when the concentration Df (vaporization proportion) of the fuel exceeds 50%, are switched as needed based on the concentration Df (vaporization proportion) of the fuel, so that the optimum fuel injection amount M can be determined based on the map suitable for the concentration Df (vaporization proportion) of the fuel.

While the embodiments of the invention have been described in detail with reference to the drawings, the invention may be applied in other forms.

For example, the embodiments described above independently of each other may be implemented in combination as needed within a consistent range.

While the hybrid control, engine control, shift control, etc. are performed by the single electronic control unit 70 in the above-described embodiments, these control functions are not necessarily performed by the single electronic control unit. Rather, a control unit for hybrid control, a control unit for engine control, and a control unit for shift control may be provided independently of one another, and the respective control units may send and receive signals to and from each other.

While the invention is applied to the hybrid vehicle 10 in the above-described embodiments, the invention is not limitedly applied to vehicles of hybrid type, but may be applied as needed to other types of vehicles provided that they have the idle stop function.

While the direct-injection type internal combustion engine in which the fuel is injected directly into the cylinders is used as the engine 12 in the above-described embodiments, the engine 12 is not limited to the direct-injection type internal combustion engine, but the invention may be applied to another type of engine in which the fuel is injected into an intake passage.

While the in-cylinder temperature of the engine 12 is estimated based on the engine coolant temperature Tw in the above-described embodiments, the basis on which the in-cylinder temperature is estimated is not limited to the engine coolant temperature Tw, but the in-cylinder temperature may be estimated based on another parameter, such as the temperature of the cylinder block of the engine 12, or the oil temperature of the engine oil.

While the temperature T50 at which about 50% of the fuel is vaporized is used as the given temperature T1 in the above-described embodiments, the given temperature T1 is not limited to the temperature T50, but a temperature at which about 80% of the fuel is vaporized, for example, may be used as the given temperature T1.

While the required fuel amount correction maps are switched based on whether the fuel concentration exceeds 50% in the above-described embodiments, the basis on which the required fuel amount correction map is selected is not limited to 50%, but the map may be selected depending upon whether the fuel concentration is 80% or higher, for example.

While two maps are switched based on the given temperature T1 or the predetermined value of the vaporization proportion of the fuel in the above-described embodiments, three or more maps may be set, according to the engine coolant temperature Tw or the vaporization proportion of the fuel.

It is to be understood that the embodiments as described above are mere examples, and that the invention may be embodied with various changes or improvements, based on the knowledge of those skilled in the art.

What is claimed is:

1. A control system that automatically stops and automatically restarts an internal combustion engine of a vehicle, the control system comprising:

a vapor pressure sensor that detects a vapor pressure of a fuel; and an electronic control unit configured to:

a) set a fuel injection amount when the internal combustion engine is automatically restarted such that the fuel injection amount is reduced as a temperature in a cylinder of the internal combustion engine at a time of automatic restart is higher, and b) set a relationship between the vapor pressure of the fuel and the fuel injection amount by switching between a first map and a second map based on the temperature in the cylinder, the first map is used for determining the fuel injection amount only when the temperature in the cylinder is equal to or lower than a predetermined temperature; and the second map is used for determining the fuel injection amount only when the temperature in the cylinder exceeds the predetermined temperature, such that a rate of change of the fuel injection amount relative to the vapor pressure increases as the temperature in the cylinder is higher.

2. The control system according to claim 1, wherein the electronic control unit is configured to set the relationship between the vapor pressure of the fuel and the fuel injection amount such that the rate of change is positive when the temperature in the cylinder is equal to or higher than a predetermined value.

3. The control system according to claim 1, wherein the electronic control unit is configured to estimate the temperature in the cylinder based on an engine coolant temperature.

4. A control system that automatically stops and automatically restarts an internal combustion engine of a vehicle, the control system comprising:

a vapor pressure sensor that detects a vapor pressure of a fuel; and an electronic control unit configured to:

a) set a fuel injection amount when the internal combustion engine is automatically restarted such that the fuel injection amount is reduced as a vaporization proportion of the fuel at a time of automatic restart is higher, and b) set a relationship between the vapor pressure of the fuel and the fuel injection amount by switching between a first map and a second map based on the vaporization proportion of the fuel, the first map is used for determining the fuel injection amount only when the vaporization proportion of the fuel is equal to or lower than a predetermined proportion, such that a rate of change of the fuel injection amount relative to the vapor pressure increases as the vaporization proportion of the fuel is higher.

5. The control system according to claim 4, wherein the electronic control unit is configured to set the relationship between the vapor pressure of the fuel and the fuel injection amount such that the rate of change is positive when the vaporization proportion of the fuel is equal to or larger than a predetermined value.

6. A control system that automatically stops and automatically restarts an internal combustion engine of a vehicle, the control system comprising:

an electronic control unit configured to:

a) estimate a vapor pressure of a fuel, b) set a fuel injection amount when the internal combustion engine is automatically restarted such that the fuel injection amount is reduced as a temperature in a cylinder of the internal combustion engine at a time of automatic restart is higher, and c) set a relationship between the vapor pressure of the fuel and the fuel injection amount by switching between a first map and a second map based on the temperature in the cylinder, the first map is used for determining the fuel injection amount only when the temperature in the cylinder is equal to or lower than a predetermined temperature, such that a rate of change of the fuel injection amount relative to the vapor pressure increases as the temperature in the cylinder is higher.

7. The control system according to claim 6, wherein the electronic control unit is configured to set the relationship between the vapor pressure of the fuel and the fuel injection amount such that the rate of change is positive when the temperature in the cylinder is equal to or higher than a predetermined value.

8. The control system according to claim 6, wherein the electronic control unit is configured to estimate the temperature in the cylinder based on an engine coolant temperature.

9. The control system according to claim 6, wherein the electronic control unit estimates the vapor pressure of the fuel based on a fuel temperature and an internal pressure in a fuel tank.

10. The control system according to claim 6, wherein the electronic control unit estimates the vapor pressure of the fuel based on a rate of change of an engine speed at a time of a cold start.

11. A control system that automatically stops and automatically restarts an internal combustion engine of a vehicle, the control system comprising:

an electronic control unit configured to:

a) estimate a vapor pressure of a fuel, b) set a fuel injection amount when the internal combustion engine is automatically restarted such that the fuel injection amount is reduced as a vaporization proportion of the fuel at a time of automatic restart is higher, and c) set a relationship between the vapor pressure of the fuel and the fuel injection amount by switching between a first map and a second map based on the vaporization proportion of the fuel, the first map is used for determining the fuel injection amount only when the vaporization proportion of the fuel is equal to or lower than a predetermined proportion, such that a rate of change of the fuel injection amount relative to the vapor pressure increases as the vaporization proportion of the fuel is higher.

12. The control system according to claim 11, wherein the electronic control unit is configured to set the relationship between the vapor pressure of the fuel and the fuel injection amount such that the rate of change is positive when the vaporization proportion of the fuel is equal to or larger than a predetermined value.

13. The control system according to claim 11, wherein the electronic control unit estimates the vapor pressure of the fuel based on a fuel temperature and an internal pressure of a fuel tank.

14. The control system according to claim 11, wherein the electronic control unit estimates the vapor pressure of the fuel based on a rate of change of an engine speed at a time of a cold start.

15. The control system according to claim 1, wherein the second map is used for determining the fuel injection amount only when the temperature in the cylinder exceeds the predetermined temperature, such that a rate of change of the fuel injection amount relative to the vapor pressure increases as a sliding scale as the temperature in the cylinder is higher.

16. The control system according to claim 4, wherein the second map is used for determining the fuel injection amount only when the vaporization proportion of the fuel exceeds the predetermined proportion, such that a rate of change of the fuel injection amount relative to the vapor pressure increases as a sliding scale as the vaporization proportion of the fuel is higher.

17. The control system according to claim 6, wherein the second map is used for determining the fuel injection amount only when the temperature in the cylinder exceeds the predetermined temperature, such that a rate of change of the fuel injection amount relative to the vapor pressure increases as a sliding scale as the temperature in the cylinder is higher.

18. The control system according to claim 11, wherein the second map is used for determining the fuel injection amount only when the vaporization proportion of the fuel exceeds the predetermined proportion, such that a rate of change of the fuel injection amount relative to the vapor pressure increases as a sliding scale as the vaporization proportion of the fuel is higher.

* * * * *